US005400836A

United States Patent [19]

Divall

[11] Patent Number: 5,400,836

[45] Date of Patent: Mar. 28, 1995

[54] FILLING FLOWABLE PRODUCTS INTO RECEPTACLES

[75] Inventor: John E. Divall, Oxfordshire, United Kingdom

[73] Assignee: Carnaudmetalbox plc, United Kingdom

[21] Appl. No.: 170,242

[22] PCT Filed: Jun. 24, 1992

[86] PCT No.: PCT/GB92/01143

§ 371 Date: Mar. 3, 1994

§ 102(e) Date: Mar. 3, 1994

[87] PCT Pub. No.: WO93/00263

PCT Pub. Date: Jan. 7, 1993

[30] Foreign Application Priority Data

Jun. 26, 1991 [GB] United Kingdom ..... 9113932

[51] Int. Cl.[6] ..... B65B 3/04

[52] U.S. Cl. ..... 141/1; 141/131; 141/270; 222/412

[58] Field of Search ..... 141/1, 131, 134, 270; 222/412, 413, 414

[56] References Cited

U.S. PATENT DOCUMENTS

| | | | |
|---|---|---|---|
| 1,420,222 | 6/1922 | Schmidt | 141/134 |
| 2,631,768 | 3/1953 | Martin et al. | 141/134 |
| 2,827,928 | 3/1958 | Guckel | 141/134 |
| 2,934,101 | 4/1960 | Guckel | 141/134 X |
| 3,442,304 | 5/1969 | Guckel et al. | 141/134 |
| 4,387,834 | 6/1983 | Bishop | 222/413 X |

FOREIGN PATENT DOCUMENTS

| | | | |
|---|---|---|---|
| 786366 | 11/1957 | United Kingdom . | |
| 2222150 | 8/1988 | United Kingdom . | |
| 761389 | 9/1980 | U.S.S.R. | 222/412 |
| 1562239 | 5/1990 | U.S.S.R. | 222/412 |

*Primary Examiner*—Ernest G. Cusick
*Attorney, Agent, or Firm*—Diller, Ramik & Wight

[57] ABSTRACT

An apparatus for and a method of filling a flowable product into a succession of receptacles as they pass continuously along a predetermined path is defined by an elongated hollow containment member mounted above the predetermined path which is formed with an axially extending slot therein. A metering screw having a helical thread is mounted for rotation within the containment member and is biased into sealing engagement with the containment member on each side of the slot. A distribution chamber is formed within the containment member substantially around the screw member except that the sealing engagement and the slot whereby flowable products supplied to the distribution chamber when the screw is rotated is distributed through the slot between adjacent screw portions of the screw member and leaves the containment member in a succession of spaced moving streams.

15 Claims, 6 Drawing Sheets

16
30
28
18A
26
14
18B
12

9
20
86
88
87
II
II
16
24
22
80
26
18
18B
32
28
30
18B
14
18A
80
26
18A
10
89
8
12

FILLING FLOWABLE PRODUCTS INTO RECEPTACLES

BACKGROUND OF THE INVENTION

This invention relates to the filling of flowable products into receptacles.

In the filling or charging of fruit juices or other liquid drink products into packaging containers there exists a need for an apparatus and method whereby accurately metered doses of the product may be generated and placed in the containers as the latter move continuously along a filling and closing line.

SUMMARY OF THE INVENTION

In accordance with the oresent invention from a first aspect thereof there is accordingly provided apparatus for filling a flowable product into a succession of receptacles as they pass continuously along a predetermined path, the apparatus comprising an elongate hollow containment member mounted or mountable to extend along and above the container path and formed with an axially extending slot, and a metering screw having a helical thread and mounted for rotation within the containment member, the metering screw being movable away from the slot but biassed towards and into sealing engagement with the containment member on each side of the slot, and there being a distribution chamber formed within the containment member substantially around the screw member except at the sealing engagement and the slot whereby flowable product supplied to the distribution chamber when the screw member is rotating may be distributed to pass through the slot between adjacent turns of the screw member and leave the containment member as a succession of spaced moving streams.

From a second aspect thereof the invention also provides the method of filling a flowable product into receptacles which is employed by the apparatus defined above. Accordingly, the method comprises rotating a screw member having a helical thread within a containment member having an elongate slot on either side of which the turns of the thread make sealing engagement, and supplying the flowable product to a distribution chamber formed within the containment member substantially around the screw member except at the sealing engagement and the slot so that the flowable product issues through the slot between adjacent turns of the thread.

For liquid products in particular it may be possible, when the supply of liquid product to the chamber is interrupted and the screw member is non-rotating, to rely on surface tension in the vicinity of the dispensing slot to prevent any substantial flow of liquid product through the slot. As an alternative, however, a positive obstruction such as a slide plate may be provided and movable to close off the slot when no product flow is required. This latter arrangement is of particular value for aseptic applications, when it is required to clean the apparatus with superheated water or steam.

BRIEF DESCRIPTION OF THE DRAWINGS

The nature of the invention will become clearer from the following description of embodiments of the invention, now to be given by way of example and with reference to the accompanying drawings. In the drawings.

DESCRIPTION OF THE PREFERRED EMBODIMENTS

Figure 2:
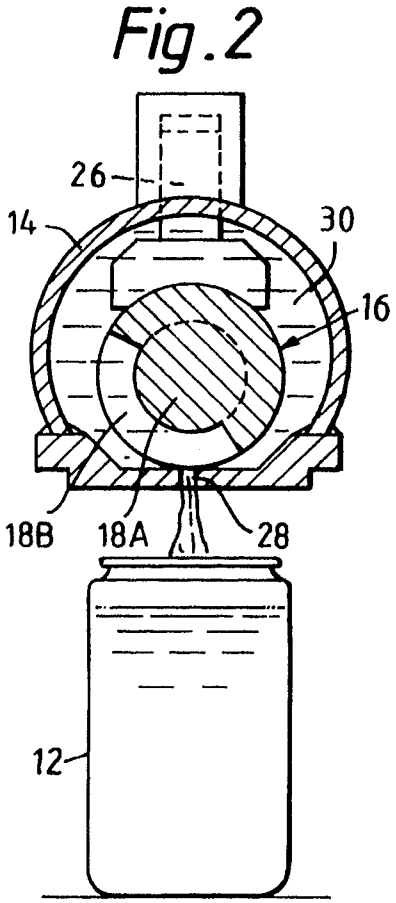
FIG. 2 similarly shows the apparatus when seen diagrammatically in end elevation taken in section on the line II—II of FIG. 1.
Figure 1:
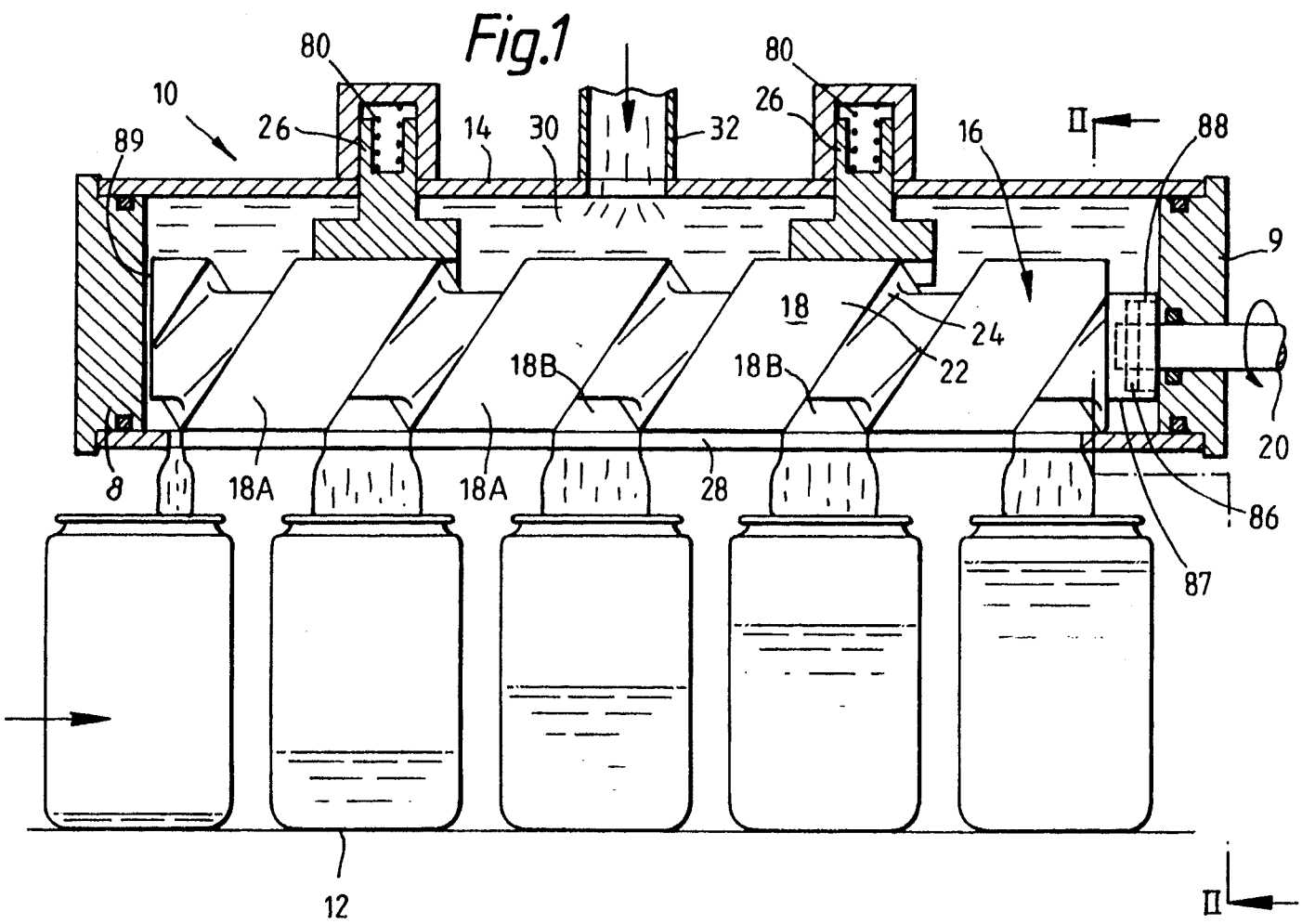
FIG. 1 is a diagrammatic view of a filling apparatus in accordance with the invention, as seen in side elevation and when in operation to fill a liquid product into a succession of regularly spaced containers as they pass along a filling and closing line.

Referring firstly to FIGS. 1 and 2, a filling apparatus 10 is shown in relation to open-topped containers 12 which are being moved from left to right (FIG. 1) at a regular spacing and at a uniform speed along a horizontal path. The containers shown are metal cans, and the apparatus is being used for filling them with a liquid drink product. It is to be understood that after passing the apparatus the cans are moved to a seamer (not shown), by which they are closed by easy-opening end closures in conventional manner.

Briefly stated, the apparatus has a containment member in the form of an elongate hollow tube 14 of substantially circular cross section which extends along and above the conveyor path and is closed by end caps 8, 9 at its ends.

A metering screw 16 having a helical thread 18 extends along and within the tube and is drivable to rotate by a motor (not shown) acting through a shaft 20 at the container exit end of the apparatus.

The thread 18 has several turns 18A of essentially rectangular contour (i.e. with a cylindrical periphery 22 and radially directed flanks 24), which are separated by portions 18B of a continuous helical gap. The metering screw is located so that these turns make sliding contact with the base of the tube. Bearings 26 having compression springs 80 bias the metering screw downwardly to maintain this sliding contact at all times.

Along its base and laterally within its engagement by the turns of the metering screw, the tube is formed with an elongate, continuous dispensing slot 28 typically 2 mm in width.

As is clearly apparent from FIG. 2, the metering screw has substantially smaller cross-sectional dimensions than the tube 14 and occupies only a lower portion of the interior of the tube. Around the metering screw (with the exception of its sealing engagement with the metering screw and of its slot 28) the tube forms a chamber 30 by which liquid product admitted via a central supply conduit 32 may be distributed to the gaps 18B of the screw, so as to leave the apparatus through the parts of the dispensing slot 28 which at the time in question correspond axially with the gaps.

The rotation of the metering screw is synchronised with the movement of the containers along the path, with the result that each container in turn is subjected to a continuous and respective stream of liquid product which is first produced as the container passes beneath the upstream end of the dispensing slot 28 and is terminated as the container passes the downstream end of the dispensing slot.

The product streams associated with adjacent containers are separated by a gap where a turn 18A of the metering screw 16 makes sealing engagement with the interior of the tube 14 on each side of the dispensing slot 28 (in the circumferential direction of the tube).

Figure 2A:
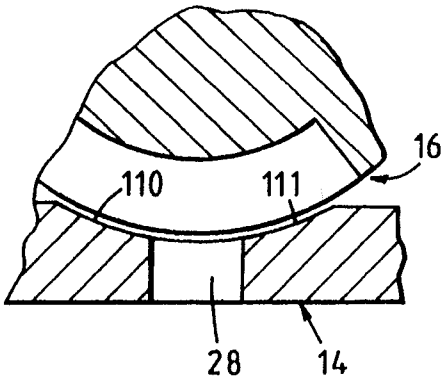
FIG. 2A is a fragmentary cross sectional view showing part of FIG. 2 to an enlarged scale.

FIG. 2A shows to an enlarged scale the detail of the sealing engagement of the metering screw with the tube. Adjacent the sides of the slot the interior of the tube is formed with part-circular sealing surfaces 110, 111 which are centred on the axis of rotation of the metering screw. For clarity the sealing surfaces are shown when separated from the metering screw, but it will be appreciated that during normal dispensing they will be in contact with the metering screw.

Over most of the movement of each container beneath the dispensing slot 28, the associated stream of liquid product has a width and length corresponding substantially and respectively to the width of the dispensing slot and to the screw gap 18B. The screw gap is accordingly chosen to be substantially less than the container diameter. At the beginning and end of the movement the length of the stream increases in known manner from zero to full length, and vice versa, with the progressively varying correspondence of the gap 18B with the dispensing slot.

Whilst not apparent from the drawings it is to be understood that the liquid product to be filled into the containers 12 is supplied to the distribution chamber 30 via the supply conduit 32 under a small hydrostatic pressure which ensures that the chamber is full of product at all times.

By control of the speed of movement of the containers and their respective product streams along the apparatus and/or the hydrostatic pressure of the liquid product, it is possible to control accurately the amount of liquid product which is filled into each container before it passes to the seamer for closing.

If at any time it is desired to halt the filling operation, a valve (not shown) upstream of the supply conduit is closed and at the same time the drives for the metering screw and the containers to be filled are deenergized. Under such conditions no further product is dispensed, and leakage through the dispensing slot 28 is prevented by surface tension of the product which holds the product within the tube against the small hydrostatic head which is present. For this purpose the width of the dispensing slot 28 is selected having in mind the surface properties of the product and the magnitude of the hydrostatic head.

Figure 3A:
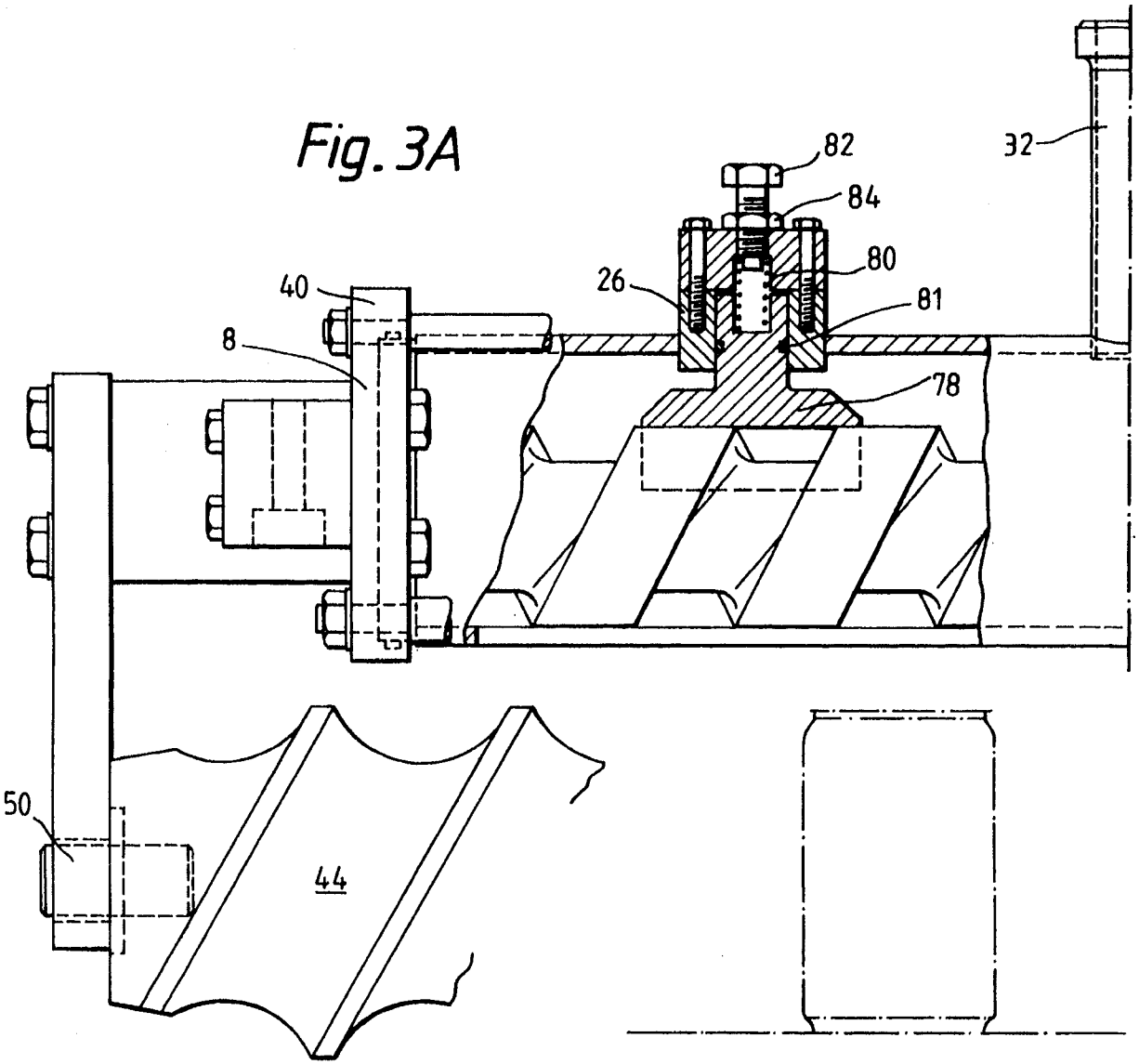
FIGS. 3A and 3B together show a variant of the apparatus of FIGS. 1 and 2, as seen in side elevation and when partly broken away to reveal internal structure.
Figure 3B:
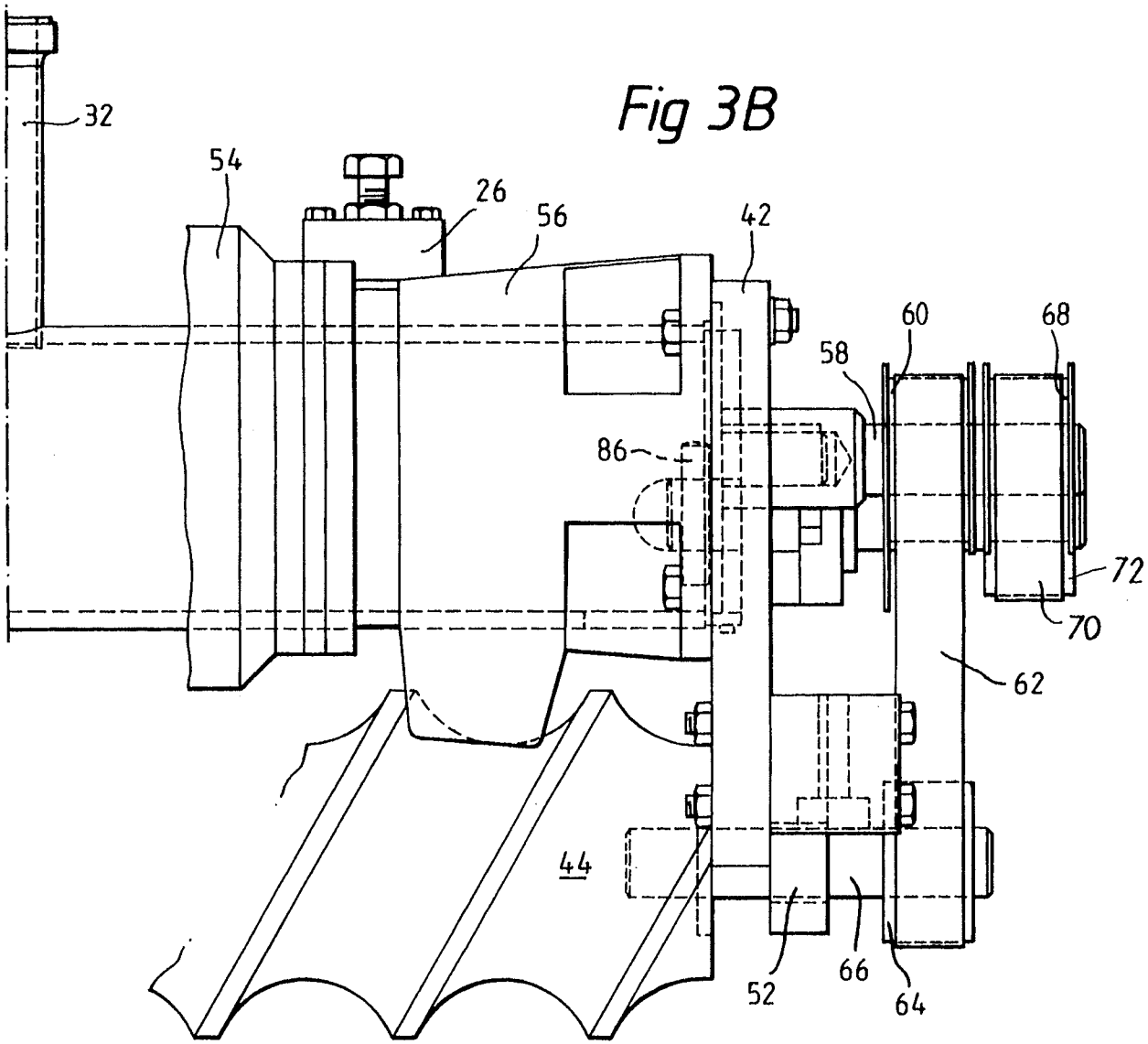
Figure 4:
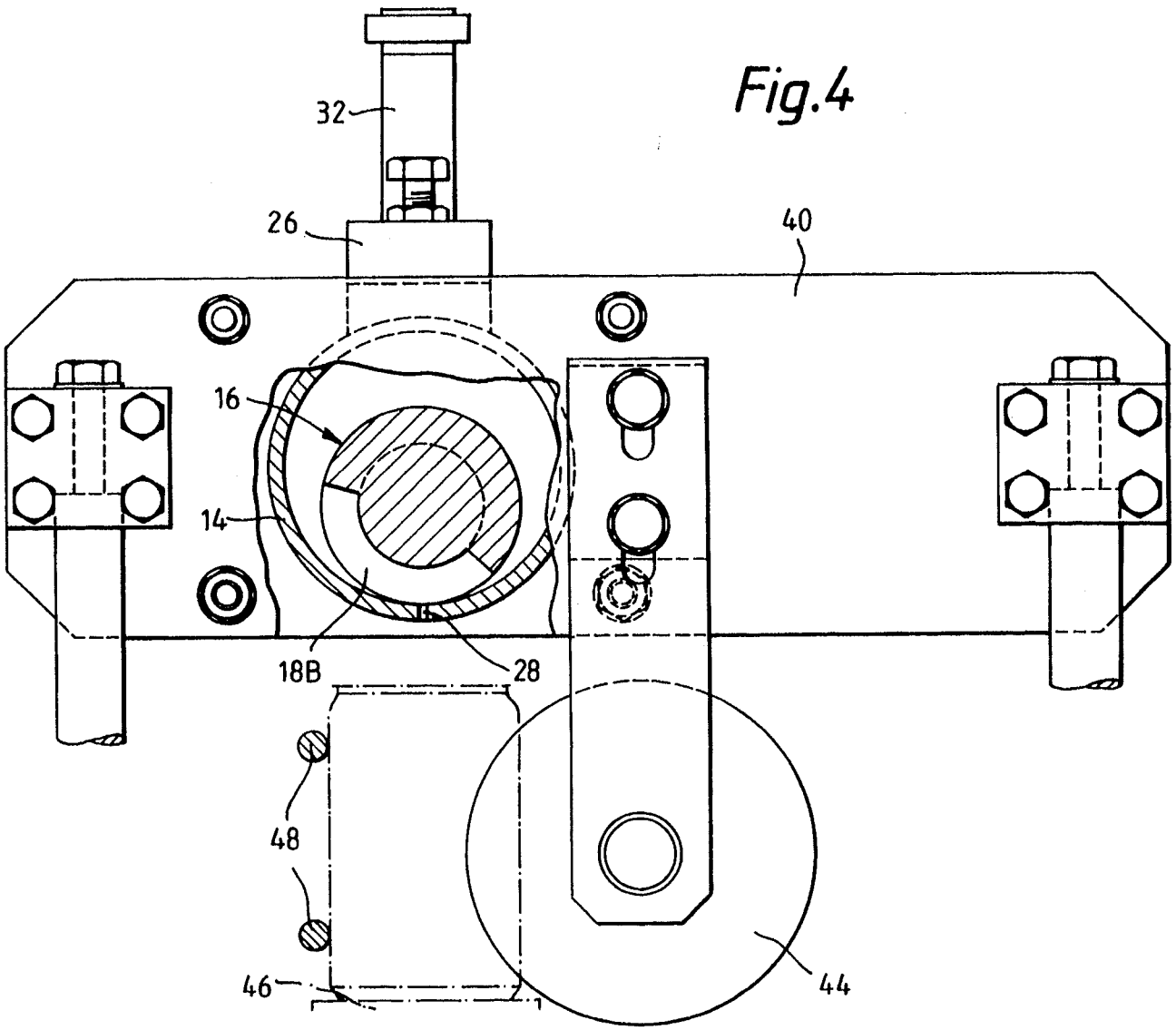
FIG. 4 shows the apparatus of FIGS. 3A, 3B in end elevation as seen looking in the direction of container movement.
Figure 5:
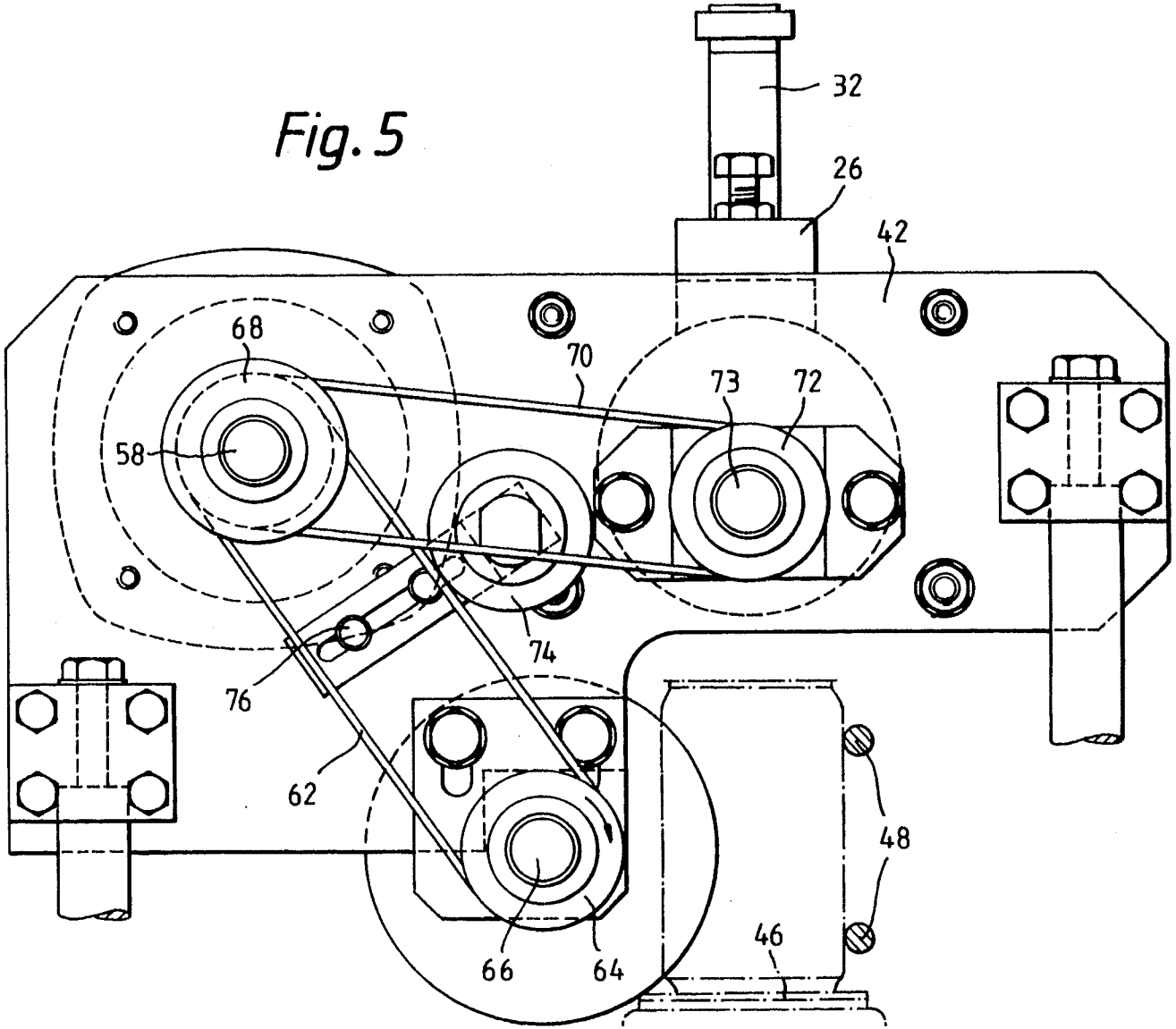
FIG. 5 similarly shows the apparatus of FIGS. 3A, 3B looking backwardly towards the on-coming containers.

Reference is now made to FIGS. 3 to 5 which show the apparatus in greater detail and with minor modifications not affecting its mode of operation. The apparatus is supported from the ground by end plates 40, 42 at its entry and exit ends. The containers are moved through the apparatus by a drive scroll 44 when supported from beneath by a deadplate 46. The drive scroll 44 is disposed on one side of the containers, the right hand side as seen in the downstream direction of the apparatus. Guide bars 48 define the limits of the container path on the opposite side of the containers. The pitch of the drive scroll is the same as that of the metering screw 16.

The drive scroll 44 is supported by bearings 50, 52 at each end and is driven to rotate by an electric motor 54 acting through, in succession, reduction gear 56, shaft 58, sprocket wheel 60, toothed belt 62, sprocket wheel 64 and shaft 66. The motor additionally drives the metering screw 16 through sprocket wheel 68 on the shaft 58, toothed belt 70, sprocket wheel 72, and shaft 73. The drive scroll is extended beyond the metering screw at the entry end of the apparatus to ensure that the containers have a uniform and controlled movement as they approach the dispensing slot.

The two screws are thus driven in common by the same motor, and their drives are set to achieve the synchronisation previously described. Fine adjustment is provided by a roller 74 which engages the exterior of the belt 62 and the position of which (in relation to the belt) is adjustable by locking bolts 76.

From FIG. 4 the dispensing slot 28 and its relationship to the tube 14 can be readily understood. The relative narrowness of the dispensing slot, and the manner in which it is closed off by the metering screw 16 except at the screw gaps 18B are also apparent. It is preferred that the tube is of stainless steel and the metering screw is of a hard polymeric material such as PES (Poly Ether Sulphone).

The arrangement of each of the two spring-loaded biassing bearings 26 is apparent from FIG. 3A, which shows one of them in section. Each biassing bearing has a presser foot 78 which is biassed by a compression spring 80 downwardly into sliding contact with the metering screw 16 beneath. The spring is adjustably pre-loaded by setting bolt 82 and locking nut 84. The presser foot has an axial extent which is somewhat greater than one thread pitch on the thread 18, so as at all times to engage the metering screw evenly, that is, without any tendency to tilt. An 'O'-ring 81 engages the presser foot to provide a fluid and gas-tight seal for the biassing bearing.

In order to allow the metering screw complete freedom to make sealing engagement with the interior of the tube 14 as described, it is loose within the tube, that is to say, its ends are essentially unconstrained in the radial sense. Lateral location of the metering screw within the tube is provided by a combination of gravity, the hydrostatic pressure of the product, and the presser feet 78 which engage the metering screw over a part-circular contact area (FIG. 3A) to provide a centering action as well as a vertically downward biassing force. The rotary drive for the metering screw incorporates a transversely extending drive pin 86 and a driven member 87 (FIG. 1) having a slot 88 in which the pin is located in a manner which allows the screw freedom to move both laterally and longitudinally. At its opposite end, i.e. at the entry end of the apparatus, the metering screw is free of any engagement except the desired sealing engagement with the tube interior and occasional brushing engagement of its plane end face 89 (FIG. 1) with the end cap 8 for longitudinal location.

As particularly described above the apparatus shown in the drawings is designed for handling wholly liquid products having physical characteristics similar to those of water. However, the invention is not limited for use with such products; it may, for example, be adapted for use with liquid products which contain particulate or lumpy matter. As will be understood from the embodiment to be described with reference to FIG. 7, for such products it will not be appropriate to rely upon surface tension to prevent leakage through the dispensing slot when the apparatus is inoperative, and a mechanical means such as a slide plate may be provided for that purpose.

A particular advantage accruing from the substantially complete access and mobility of the metering screw within the containment member is the efficiency with which the internal surfaces of the apparatus can be cleaned. When cleaning is required, cleaning fluid is supplied to the supply conduit 32 so as progressively to replace the liquid product within the tube 14 and subsequently to clean the interior surfaces of the apparatus. The cleaning fluid is then replaced by rinsing water in preparation for continued supply of the liquid product. Cleaning efficiency is further enhanced by hydraulic action exerted upwardly on the biassing bearings 26 during cleaning. This relieves the pressure of the presser feet 78 on the metering screw, and by reducing the contact forces at the engagement of the metering screw with the tube 14 allows the cleaning fluid or water, the case may be, to penetrate and treat the sealing interfaces.

Figure 6:
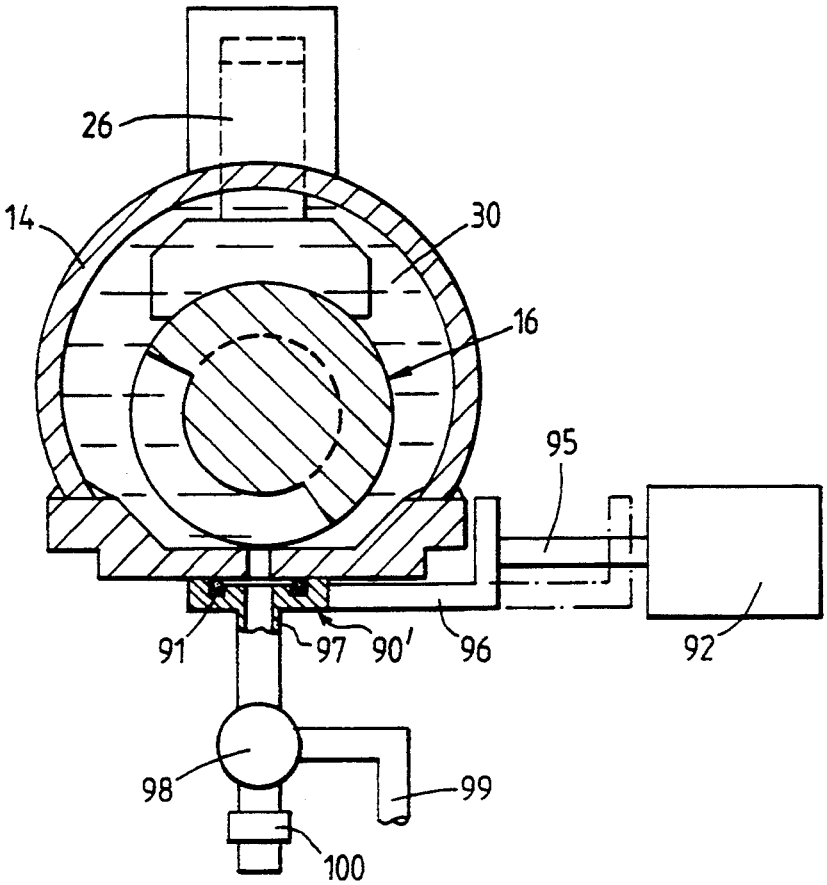
FIG. 6 is a view corresponding to FIG. 2 of a first modified filling apparatus.
Figure 7:
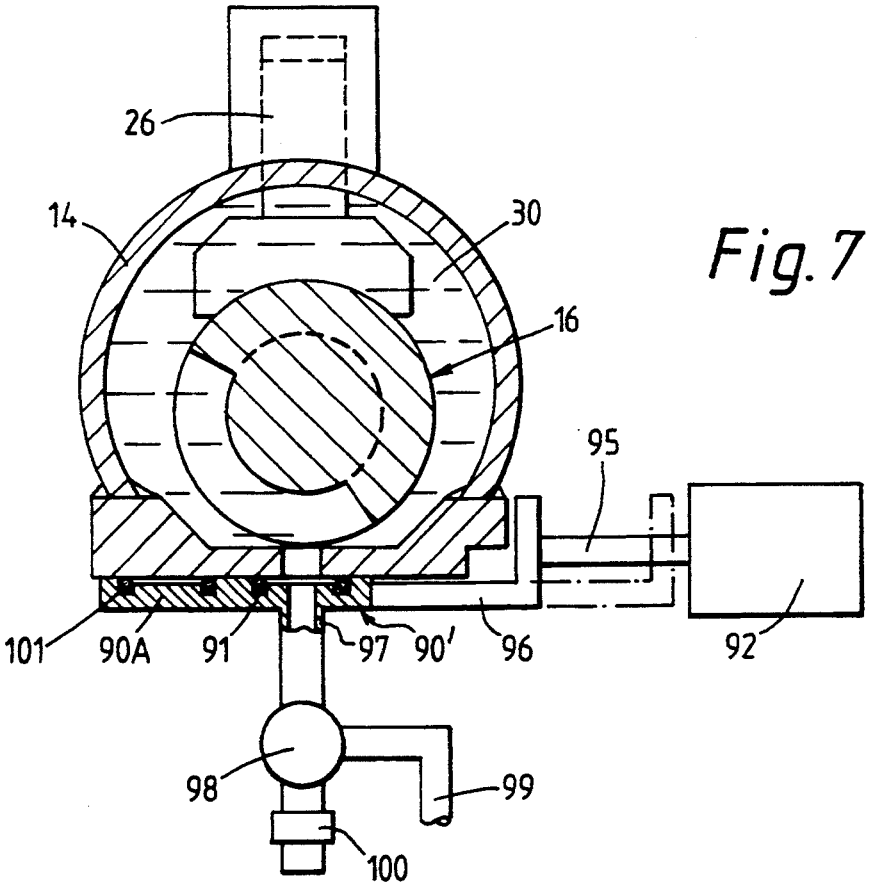
FIG. 7 similarly shows a second modified filling apparatus.

FIGS. 6 and 7 show the apparatus of FIGS. 1 and 2 when modified for aseptic operation and respectively as arranged for dispensing a liquid product such as a fruit drink and a particulate product such as baked beans in tomato sauce.

Referring firstly to FIG. 6, the apparatus of FIGS. 1 and 2 is modified by addition of a slide plate 90. The slide plate has an elongate 'O'-ring 91 for sealing, and is mounted by guides (not shown) for movement between the operative position shown and the retracted position indicated by the broken line. The movement is achieved by an actuator 92 acting through rod 95 and L-shaped coupling member 96. The slide plate provides a movable entry end for a pipe 97 in which a three-way valve 98 is mounted. Operation of the three-way valve enables the pipe to be connected selectively to a cleaning fluid vent or return pipe 99, or a steam trap 100.

The slide plate is located in its retracted position for the normal dispensing of a liquid product; as described above, surface tension at the dispensing slot 28 prevents product leakage during any interruption in the dispensing operation. However, when it is required to clean the apparatus internally the slide plate is advanced by actuator 92 to the position shown, so that the 'O'-ring 91 makes a fluid and gas tight seal with the underside of tube 14 on either side of the dispensing slot 28.

The liquid product supply to the supply conduit 32 is then replaced by cleaning fluid which is passed via three-way valve 98 and pipe 99 initially to discharge and later to a CIP (Clean In Place) system associated with the apparatus.

After cleaning, the valve 98 is operated and steam is admitted via the supply conduit 32 to sterilise the interior of the apparatus and pass to steam trap 100 which generates the back pressure required in the apparatus during sterilisation. After sterilisation, the steam is replaced by hot air which dries the interior surfaces of the apparatus and is vented through the steam trap. The slide plate is then retracted in preparation for the next product dispensing operation.

In the apparatus of FIG. 7 the slide plate, now denoted 90', is extended to provide a shut-off portion 90'A with 'O'-ring 101 for sealing. When located by actuator 92 beneath the dispensing slot the shut-off portion seals the latter against the escape of product during any interruption in the dispensing operation. The dispensing slot is somewhat wider than the dispensing slot of FIG. 6, and accordingly it is denoted 28'. The items 92 and 95 to 100 are arranged and controlled to operate as before for cleaning and sterilisation; their arrangement and mode of operation are therefore not described again.

Particularly for applications where high filling speeds are required, it may be advantageous to use two or more apparatus in accordance with the invention in series. Also, the thread of the metering screw may be a multistart thread if desired.

I claim:

1. Apparatus for filling a flowable product into a succession of receptacles as they pass continuously along a predetermined path comprising an elongate hollow containment member mountable to extend along and above a predetermined container path and formed with an axially extending slot, a metering screw having a helical thread, said metering screw being mounted for rotation within the containment member, the metering screw being movable away from the slot but biassed towards and into sealing engagement with the containment member on each side of the slot, and a distribution chamber formed within the containment member substantially abound the screw member except at the sealing engagement and the slot whereby flowable product supplied to the distribution chamber when the screw member is rotating may be distributed to pass through the slot between adjacent screw portions of the screw member and leave the container member as a succession of spaced moving streams.

2. Apparatus in accordance with claim 1, which further includes a scroll having a thread pitch corresponding to a thread pitch of the screw member and arranged to drive the receptacles along the predetermined path in synchronism with the moving liquid streams.

3. Apparatus in accordance with claim 1 which includes a biassing means operable upon the screw member to bias it downwardly into sealing engagement with an interior of the containment member.

4. Apparatus in accordance with claim 3, wherein the biassing means slidably engages the helical thread of the screw member.

5. Apparatus in accordance with claim 3 wherein except by the biassing means the screw member is laterally unconstrained within the tube.

6. Apparatus in accordance with claim 1 which includes shut-off means operable for closing the dispensing slot.

7. Apparatus in accordance with claim 6, wherein the shut-off means is arranged to generate a back-pressure for sterilizing medium admitted to the distribution chamber.

8. Apparatus in accordance with claim 2 which includes a biassing means operable upon the screw member to bias it downwardly into sealing engagement with an interior of the containment member.

9. Apparatus in accordance with claim 4 wherein except by the biasing means the screw member is laterally unconstrained within the tube.

10. Apparatus in accordance with claim 2 which include shut-off means operable for closing the dispensing slot.

11. Apparatus in accordance with claim 3 which include shut-off means operable for closing the dispensing slot.

12. Apparatus in accordance with claim 4 which include shut-off means operable for closing the dispensing slot.

13. Apparatus in accordance with claim 5 which include shut-off means operable for closing the dispensing slot.

14. A method of filling a flowable product into a succession of receptacles as they pass continuously along a predetermined path comprising the steps of rotating a screw member having a helical thread within a containment member having an elongate dispensing slot on either side of which the turns of the thread make sealing engagement, and supplying the flowable product to a distribution chamber formed within the containment member substantially around the screw member except at the sealing engagement and the slot so that the flowable product issues through the slot between adjacent thread portions of the thread.

15. A method in accordance with claim 14, wherein the flowable product is a liquid, and when the supply of liquid to the chamber is interrupted and the screw member is non-rotating, any substantial flow of the liquid through the dispensing slot is prevented by surface tension of the liquid in the vicinity of the dispensing slot.

* * * * *